US005389752A

United States Patent [19]

Karbassi

[11] Patent Number: 5,389,752

[45] Date of Patent: Feb. 14, 1995

[54] SWITCH CONTROL LEVER

[75] Inventor: Hassan Karbassi, Hartland, Wis.

[73] Assignee: Hydro Electronic Devices, Inc., Hartford, Wis.

[21] Appl. No.: 946,591

[22] Filed: Sep. 18, 1992

[51] Int. Cl.[6] ..... H01H 9/06

[52] U.S. Cl. ..... 200/61.85; 307/114

[58] Field of Search ..... 200/61.85, 61.87, 61.88, 200/5 R; 307/114

[56] References Cited

U.S. PATENT DOCUMENTS

| | | | |
|---|---|---|---|
| 3,774,000 | 11/1973 | Beer | 200/172 A |
| 3,971,902 | 7/1976 | Wulf et al. | 200/5 A |
| 4,136,270 | 1/1979 | Wernet et al. | 200/340 |

*Primary Examiner*—A. D. Pellinen
*Assistant Examiner*—Michael A. Friedhofer
*Attorney, Agent, or Firm*—Nilles & Nilles

[57] ABSTRACT

A control lever is provided for actuating a deadman's switch or any other switch actuatable by a lever. The control lever is resilient and includes a base portion fixed to the support on which the switch is mounted and an actuator portion which is formed integral with the base portion and which extends over the switch. The actuator portion is deflectable into contact with the switch without the interaction of any pivot element, hinge, or any other connection of the control lever to the support. The lever can be easily actuated with any portion of the operator's hand and preferably is sufficiently resilient to prevent the function of the switch from being defeated by the insertion of a facing object between the lever and the switch and to prevent or at least inhibit damage to the switch due to overpressure on the lever. The lever is preferably pliable and thus can be bent or twisted in virtually any direction without damaging the lever.

10 Claims, 3 Drawing Sheets

SWITCH CONTROL LEVER

BACKGROUND OF THE INVENTION

1. Field of the Invention

The invention relates to control levers and, more particularly, relates to control levers which can be deflected into contact with a switch such as a deadman's switch to actuate the switch.

2. Description of the Related Art

Switches are used in a wide variety of industrial applications to operate devices or to prevent the operation of such devices. Many of these switches require prolonged actuation or actuation by a user who for one reason or another has part of his or her attention distracted from operation of the switch.

Typical of these switches are so-called "deadman's" switches which are provided on industrial devices such as cranes, backhoes, tractors, cherry pickers, and many other applications in which large and/or potentially dangerous equipment is operated under electrical, pneumatic, or hydraulic power. Such switches are designed to prevent movement of the control device when the operator's attention is distracted from such a device. These switches typically permit operation of the device only when they are depressed and otherwise prevent the transmission of electrical, pneumatic, or hydraulic power to valves and other devices required to operate the machine.

The typical deadman's switch comprises a simple push-button switch which is spring biased into its open position and which must be depressed into its actuated or closed position permitting operation of the device on which it is mounted. The typical switch is very small—about one-quarter of an inch in diameter—and is thus difficult to locate when the operator is not viewing the switch and is difficult to depress for extended periods of time because the user's finger or thumb becomes tired and slips off from the switch. In either event, power to the device being manipulated is unintentionally interrupted, thus leading to an inconvenient or possibly even dangerous situation.

One proposal to alleviate this problem contemplates the replacement of the small push-button switch with a larger push-button switch or so-called "mushroom" switch which requires less accurate positioning of the operator's hand. However, these switches still require relatively accurate placement of the user's thumb or forefinger and thus only partially alleviate the problems discussed above and also are very susceptible to damage and breakage.

Another proposed device designed to facilitate the actuation of a deadman's switch employs a control lever which is connected to the device on which the switch is mounted and which extends over the switch by a substantial distance and which may thus be more easily actuated. One such control lever is disclosed in U.S. Pat. No. 4,270,032, which issued to Dobberpuhl on May 26, 1981. The lever disclosed by this patent is designed for use with a deadman's switch which prevents a snow blower from operating unless the switch is depressed. The control lever is connected to the handle bar of the snowblower via a pivot pin extending transversely through the handle bar and into opposed lateral sides of the control lever. A stop pin extends out of the handle bar and into an elongated slot formed in the control lever. A return spring is provided between the handle bar and the control lever between the pivot pin and the free longitudinal end of the control lever.

The device is operated by deflecting the control lever against the biasing force of the return spring into contact with the deadman's switch, thus depressing and closing the switch and permitting operation of the machine. When the operator's hand is removed from the lever, the lever is returned to its initial position under the biasing force of the return spring, thus opening the switch and deactivating the snowblower. Movement of the control lever in both directions is limited by the return stop.

Control levers of the type discussed immediately above exhibit several disadvantages.

First, the pivot connection of the lever to the device on which it is mounted is relatively complex and is susceptible to breakage. More specifically, such pivot connections require that holes be provided in both the control lever and the device in which the lever is mounted and that a pin be inserted through or at least into the device on which the lever is mounted. Such an arrangement is particularly undesirable where delicate wires or other breakable members extend through the device on which the lever is mounted and are thus susceptible to damage during connection or disconnection of the lever to or from the device on which it is mounted. This problem may be alleviated by the replacement of the pin with an external hinge. Such a hinge, however, still requires relatively complex assembling steps.

The typical control lever of the type discussed above is also susceptible to breakage through excessive forces being imposed on the lever in any number of directions. While this problem is alleviated somewhat by the provision of the stop in the device discussed above, it cannot prevent water from seeping into the pivot connection between the lever and the device on which it is mounted and thus cannot prevent freezing and expansion of such water which could damage or destroy the connection. The problem of water damage exists whether the connection of the control lever to the device on which the switch is mounted comprises pivots, hinges, or any other such fastener permitting movement of the lever relative to the device on which it is mounted.

Another disadvantage resides in the fact that the return spring may become stuck, thus preventing actuation of the lever towards the switch, or may be broken, thus failing to assure separation of the lever from the switch when the lever is not depressed.

Still another disadvantage resides in the fact that the typical lever is made out of a rigid material such as metal. Such a lever typically has a higher spring rate than the associated switch. Accordingly, an operator may lodge an object in between the switch and the lever, thus defeating the purpose of the switch. A metallic lever may also be uncomfortable to the touch, especially when temperatures are below freezing such that the user's skin may actually freeze fast to the lever.

OBJECTS AND SUMMARY OF THE INVENTION

It is therefore an object of the invention to provide a control lever for actuating a switch which is simple in construction, which can be easily connected to the device on which the lever is mounted, and which is resistent to breakage.

It is another object of the invention to provide a control lever for a switch which prevents or at least inhibits overactuation of the lever and the resulting damage to the switch.

It is still another object of the invention to provide a control lever which is relatively pliable, which is easily accessible by any part of the hand of any operator, and which is made of a material which prevents freezing of the user's flesh to the lever.

Still another object of the invention is to provide a control lever for a deadman's switch which prevents an operator from defeating the function of the deadman's switch by wedging an element between the lever and the switch, or which at least renders more difficult such an action.

In accordance with a first aspect of the invention, a control lever for actuating a switch which is disposed on a support includes a base portion fixedly connected to the support, and an actuator portion which is formed integral with the base portion, which extends over the switch, and which is deflectable into contact with the switch.

The actuator portion and the base portion are formed from a single molded or machined elastomeric element. The actuator portion is elongated and includes a first end which is formed integral with the base portion and which extends at an angle from the base portion and a second, free end which extends over the switch.

Another object of the invention is to provide a switch which is easily and reliably actuated and which can easily be held in its actuated position for prolonged periods of time.

In accordance with this aspect of the invention, an apparatus is provided which includes a support, a switch which is disposed on the support, and a control lever including a base portion fixedly connected to the support and an actuator portion which is formed integral with the base portion, which extends over the switch, and which is deflectable into contact with the switch.

The support may comprise a joystick and the control lever may be disposed on a side surface of the joystick and extend generally parallel to a longitudinal axis of the joystick. The switch may comprise a deadman's switch which is spring biased into an open position. Preferably, the control lever has a spring constant which is lower than that of the switch so that the deadman's switch cannot be defeated.

Still another object of the invention is to provide a method of connecting a control lever for a switch onto the support on which the switch is mounted.

In accordance with this aspect of the invention, the method includes providing a control lever which is made from a single pliable element, the control lever having a base portion and an actuator portion, aligning the control lever with a support such that the actuator portion extends over a switch located on the support, and then fixing the base portion to the support.

To avoid water seepage and damage to the internal elements of the support, the fixing step preferably comprises gluing the base portion to the support.

Other objects, features, and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and other objects of the invention will become more readily apparent as the invention is more clearly understood from the detailed description to follow, reference being made to the accompanying drawings in which like reference numerals represent like parts throughout, and in which.

DETAILED DESCRIPTION OF THE PREFERRED EMBODIMENTS

Figure 1:
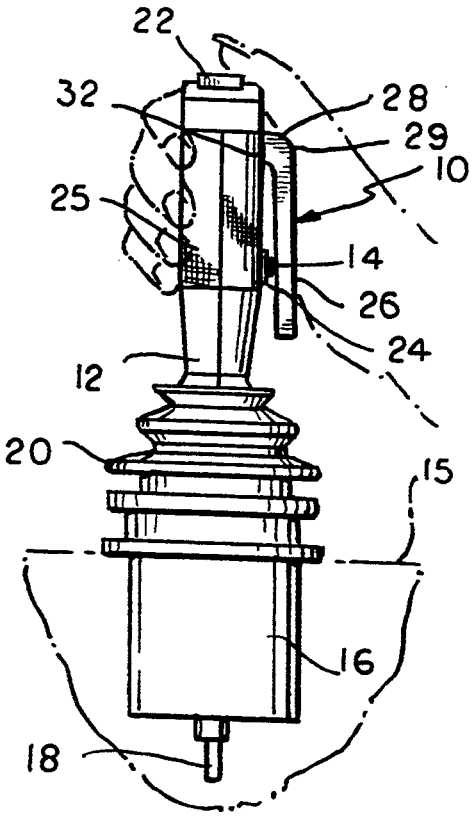
FIG. 1 is a perspective view of a control lever constructed in accordance with a first embodiment of the invention with the lever being mounted on a conventional joystick and with an operator's hand contacting but not deflecting the lever.

Pursuant to the invention, a control lever is provided for actuating a deadman's switch or any other switch actuatable by a lever. The control lever is resilient and includes a base portion fixedly connected to the support on which the switch is mounted and an actuator portion which is formed integral with the base portion and which extends over the switch. The actuator portion is deflectable into contact with the switch without the interaction of any pivot element, hinge, or any other moving connection of the control lever to the support. The lever can be easily actuated with any portion of the operator's hand and preferably is sufficiently resilient to prevent the function of the switch from being defeated and to prevent or at least inhibit damage to the switch due to overpressure on the lever. The lever is preferably pliable and thus can be bent or twisted in virtually any direction without damaging the lever.

Referring to FIGS. 1–7, a control lever 10 constructed in accordance with a first embodiment of the invention is mounted on an upper portion of a joystick grip 12 and extends generally longitudinally of the joystick grip over a switch 14.

In the disclosed embodiment, the joystick grip 12 is conventional and is mounted on a joystick which is mounted to the surface 15 of a crane or other implement having equipment which is controlled by the joystick. The joystick includes a base 16 which is disposed beneath the surface 15 of the implement and a boot 20 covering a shoulder joint or another moveable connection of the joystick grip 12 to the base 16. If desired, a rocking switch 22 or other switch may be provided on the joystick for actuating a device controlled by the joystick. The exterior of joystick grip 12 may be provided with small protrusions 25 to facilitate gripping.

The switch 14 comprises a conventional push-button switch which is spring biased into an extended, open position and which, when depressed to its closed position, permits the transmission of an electrical signal through an electrical wire (not shown), provided in cable 18, to some other device. The switch may also be normally closed or of a double throw type for other applications. The switch 14 is mounted on the joystick grip 12 via a mounting collar 24. When the switch 14 is to be used as a deadman's switch, it enables the operation of the device which is controlled by the joystick either through the transmission of electrical power to the device itself or to valves operating the device, or by directly opening valves supplying hydraulic or pneumatic fluid to the device. Of course, in the latter case, the electrical wire need not be present.

Referring to FIGS. 1–7, the control lever 10 constructed in accordance with the present invention is formed from a single resilient element. In the preferred embodiment, the control lever 10 is composed of a single molded or machined element of an elastomeric material such as polyurethane. The lever is generally L-shaped and includes an elongated, relatively thin, actuator portion 26 joined to a relatively thick and thus less resilient base portion 28 at a flex point 29.

The base portion 28 terminates in a free end face 30 which is curved to match the curvature of the mating face 32 of joystick grip 12. The base portion 28 is fixed to joystick grip 12 by gluing or otherwise affixing the face 30 of the base 28 to the mating face 32 of joystick grip 12. "Fixing" within the disclosed context does not require a non-releasable connection of the base 28 to the joystick grip 12 but instead only requires one which does not permit pivoting of the base 28 and thus of control lever 10 relative to the joystick grip 12. Thus, the control lever 10 could be connected to the joystick grip 12 through screws, bolts, or other fasteners, or could conceivably be molded as a unitary element. Gluing is the preferred form of connection primarily because it is simple and inexpensive and because it provides a watertight connection which is not susceptible to damage through the seepage of water between the two elements and the subsequent freezing of the water. Gluing also obviates the need for drilling or other preparatory machining, and avoids damage to internal components of the joystick which could be caused through the use of invasive fasteners such as bolts and screws.

The control lever 10 is connected to the joystick grip 12 by aligning the lever with the joystick grip 12 such that the actuator portion 26 extends longitudinally of the joystick grip over the switch 14, and gluing or otherwise affixing face 30 of lever 10 to the mating face 32 joystick grip 12.

The actuator portion 26 of lever 10 extends generally longitudinally of joystick grip 12 over the switch 14 and terminates in a free end disposed beyond the switch 14. Actuator portion 26 should be sufficiently long and wide to permit actuation by the thumb, palm, or fingers of one having either large or small hands and to enable the lever to be depressed for prolonged periods of time without discomfort to the operator.

Figure 2:
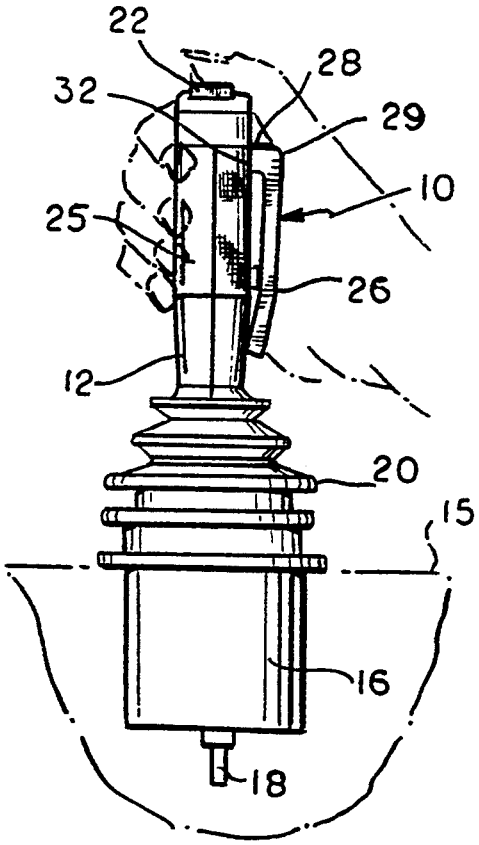
FIG. 2 is a perspective view of the lever of FIG. 1 with the lever in its depressed position.
Figure 3:
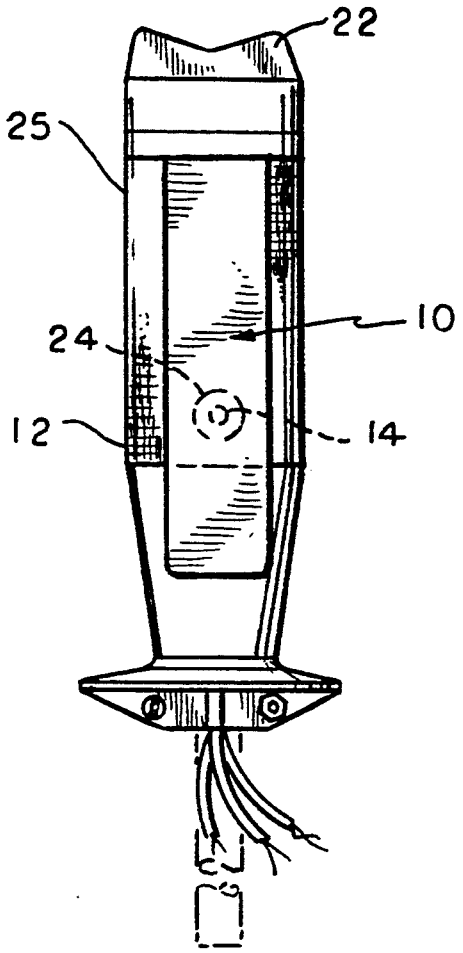
FIG. 3 is a front view of the control lever and the grip of the joystick of FIG. 1.

In operation, assuming that an equipment operator wishes to actuate the switch 14 to enable the operation of the joystick or to provide any other suitable function, he or she simply applies pressure to the actuator portion 26 of the control lever 10 with his or her hand. The actuator portion 26 of resilient lever 10 deflects about flex point 29 into contact with the switch 14, thus depressing and actuating the switch as illustrated in FIG. 2. The resiliency of the actuator portion 26 and of the flex point 29 of control lever 10 negates the need for a hinge or pivot connection of the control lever to the joystick grip 12.

Relatively little force is required to actuate the switch 14 because the distance from the switch to the flex point 29 of control lever 10 is relatively long. Relatively high torques are thus produced when relatively low forces are imposed on the actuator portion 26 of lever 10 in the vicinity of switch 14.

The resilient connection of the actuator portion 26 to the base portion 28, coupled with the inherent pliability of the elastomeric material forming the control lever 10, also enables deflection of the control lever transversely of the joystick grip 12, away from the joystick or even from side to side, thus permitting freedom of movement not possible with other connections and further reducing the chances of breakage.

Figure 4:
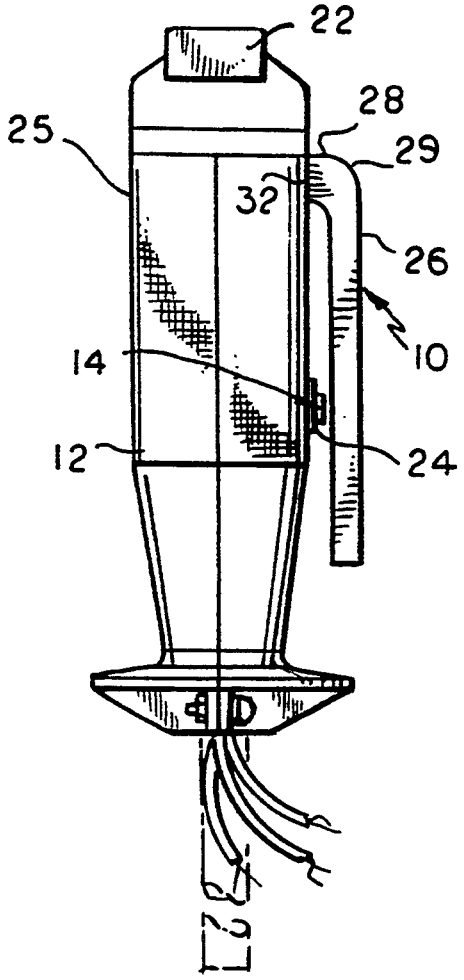
FIG. 4 is a side view of the control lever and the grip of the joystick of FIG. 1.
Figure 5:
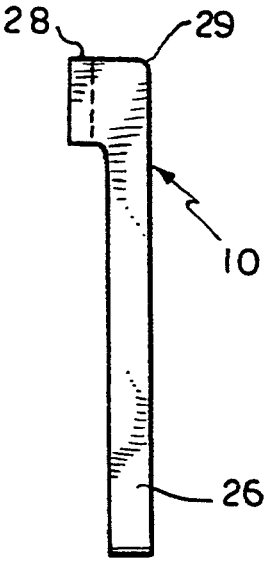
FIG. 5 is an elevation view of the control lever of FIG. 1.
Figure 6:
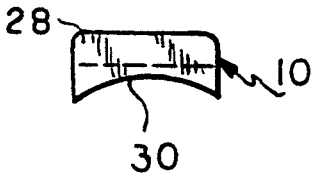
FIG. 6 is a plan view of the control lever of FIG. 1.
Figure 7:
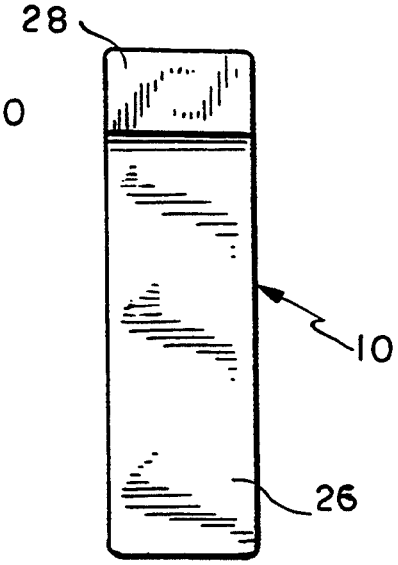
FIG. 7 is a rear view of the control lever of FIG. 1.

When the operator desires to deactuate the switch 14, he or she simply removes his or her hand from the lever 10, thus allowing the actuator portion 26 to rebound to the position illustrated in FIGS. 1 and 4 under its own resiliency. This resiliency eliminates the need for a return spring between the control lever 10 and the joystick grip 12, thus eliminating the problems associated with the use of such return springs. The switch 14 rebounds to its open position under the biasing force of a spring (not shown) provided in the joystick.

Preferably, the actuator portion 26 and flex point 29 of lever 10 have a combined spring rate which is substantially lower than that of the spring biasing switch 14 into its open position. Accordingly, when a foreign object such as a stick is wedged between the lever 10 and the switch 14, the actuator portion 26 of lever 10 deflects away from the switch 14 without the switch being depressed. This prevents the purpose of a deadman's switch from being defeated by lodging a foreign object between the lever and the switch.

The resiliency of the lever 10 also prevents or at least inhibits damage to the switch 14 when the lever is depressed, by directing overpressures away from the switch by engaging the grip 12 at its end portion under the imposition of such overpressures in the vicinity of the end portion as illustrated in FIG. 2. More specifically, if an operator were to apply excessive pressures to the inner or outer portions of the lever 10 as illustrated in FIG. 2, that portion of the lever will deflect into contact with the joystick grip 12. This in turn prevents the entire forces imposed on the lever 10 from being transmitted directly to the switch 14 and thus prevents or at least inhibits damage to the switch. Thus, unless all or substantially all of the forces imposed on the lever 10 are imposed directly on the area over the switch 14, damage to the switch is inhibited. Even this damage could be prevented or inhibited by providing a projection or lug on the lever 10 which is disposed adjacent the switch 14 and which contacts the joystick grip 12 when the switch is fully depressed.

Figure 8:
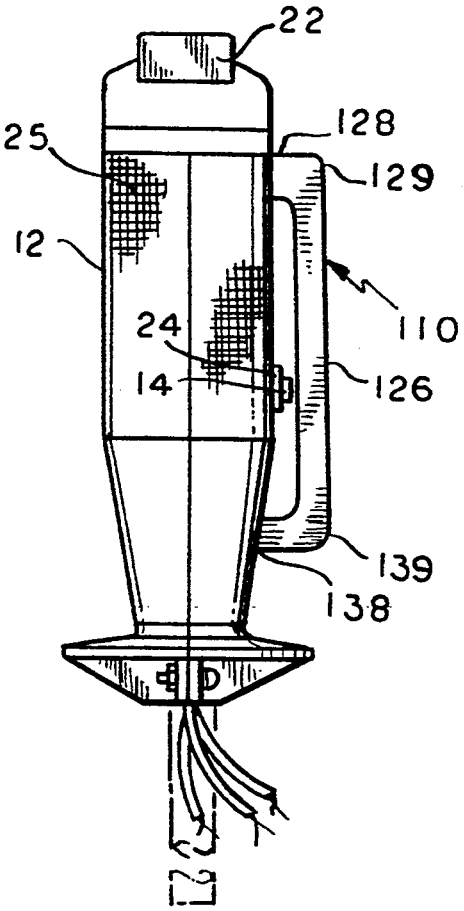
FIG. 8 is a side view of a control lever constructed in accordance with a second embodiment of the invention with the lever being mounted on the grip of a conventional joystick.
Figure 9:
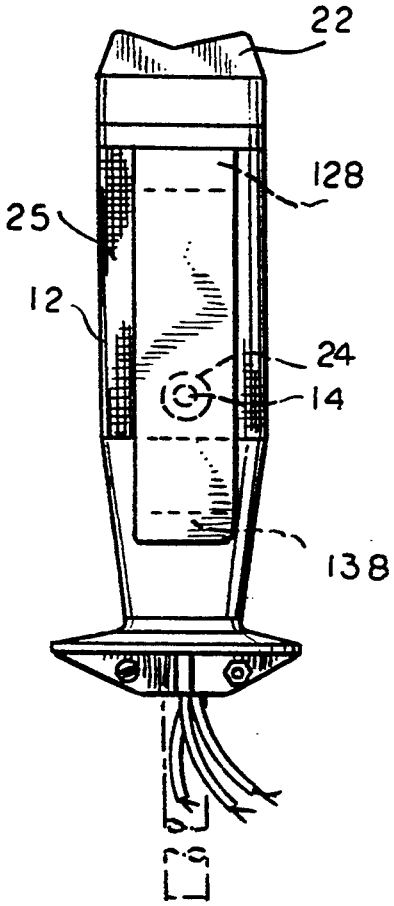
FIG. 9 is a front view of the control lever and the grip of a joystick of FIG. 8.

Referring to FIGS. 8 and 9, a control lever 110 constructed in accordance with a second embodiment of the invention is not cantilevered but instead includes a second base portion 138 glued or otherwise fixed to the joystick grip 12 at a location below the switch 14. Control lever 110 is otherwise identical to control lever 10 and includes an actuator portion 126, an upper base portion 128, and an upper flex point 129.

The provision of the second base portion 138 prevents the actuator portion 126 from flexing without substantial resistance at its lower end. The actuator portion must instead deflect at both ends at flex points 129 and 139 before it can be deflected into engagement with switch 14. Accordingly, actuation of lever 110 requires considerably more actuating force than actuation of lever 10 of the first embodiment. This may be viewed as advantageous where prevention of accidental actuation of a switch 14 is considered important.

Many changes and modifications could be made to the control lever of the present invention without departing from the spirit and scope thereof. For example, the control lever could be constructed out of spring steel or any material which is sufficiently resilient to be deflected into a switch and to actuate the switch and to rebound away from the switch under its own spring forces without the provision of any pivot or hinge elements or a return spring. However, non-metallic materials are preferred because they prevent the operator's fingers from freezing to the lever during activation of the switch. While this particular problem could be overcome by providing a resilient metallic lever which is covered with a plastic or rubber sheath, resilient elastomeric elements such as polyurethane are preferred because they are easily pliable and thus can be bent or twisted in virtually any direction without damaging the control lever.

The control lever and switch need not be provided on a movable joystick of the type illustrated and, in fact, need not be provided on a joystick at all. It is only necessary that the lever be mounted on a support and extend over the switch so that it may actuate the switch when the control lever is deflected. Moreover, the switch need not be a push button switch of the type illustrated but could comprise a mushroom switch or any other switch or device which can be actuated through contact with the lever.

I claim:

1. An apparatus comprising:
(A) a support;
(B) a switch which is disposed on said support and which is spring biased into an open position so as to have a spring constant; and
(C) a palm operated hingeless control lever formed from a resilient material, said control lever including a base portion non-pivotally fixed to said support and a hingeless actuator portion which
is connected to said base portion so as to form a hingeless connection between said base portion and said actuator portion,
is sufficiently long to receive the palm of an operator's hand and to extend over said switch,
is deflectable into contact with said switch, and which
has a spring constant which is lower than that of said switch.

2. An apparatus according to claim 1, wherein said actuator portion and said base portion are formed from a single elastomeric element.

3. An apparatus according to claim 1, wherein said actuator portion includes a first end which is formed integral with said base portion and which extends at an angle from said base portion and a second end which extends over said switch.

4. An apparatus according to claim 3, wherein said control lever further comprises a second base portion which is formed integral with said second end of said actuator portion and which is fixed to said support.

5. An apparatus according to claim 1, wherein said support comprises a joystick grip and wherein said control lever is disposed on a side surface of said joystick grip and extends generally parallel to a longitudinal axis of said joystick grip.

6. An apparatus according to claim 1, wherein said switch comprises a deadman's switch.

7. An apparatus comprising:
(A) a support;
(B) a switch which is disposed on said support; and
(C) a palm operated hingeless control lever including a base portion non-pivotally fixed to said support and a hingeless actuator portion which
is connected to said base portion so as to form a hingeless connection between said base portion and said actuator portion,
is sufficiently long to receive the palm of an operator's hand and to extend over said switch, and which
is deflectable into contact with said switch, wherein said switch is spring biased into an open position, and wherein said control lever presents an accumulative spring force which is smaller than the outward biasing forces applied to said switch.

8. An apparatus comprising:
(A) a support;
(B) a switch which is disposed on said support and which is spring biased into an open position; and
(C) a hingeless control lever which is formed from a resilient material and which includes a base portion non-pivotally fixed to said support and a hingeless actuator portion, wherein said actuator portion is
connected to said base portion so as to form a hingeless connection between said base portion and said actuator portion,
extends over said switch in a cantilevered fashion, and
is deflectable into contact with said switch, wherein said control lever presents an accumulative spring force which is smaller than the outward biasing forces applied to said switch.

9. An apparatus according to claim 8, wherein said actuator portion extends beyond said switch by a sufficient distance to assure that an end of said actuator portion contacts said support when overpressures are applied to said lever, thereby directing said overpressures away from said switch.

10. An apparatus comprising:
(A) a support;
(B) a switch which is disposed on said support and which is spring biased into an open position; and
(C) a hingeless control lever which is formed from a pliable material and which includes a base portion non-pivotally fixed to said support and a hingeless actuator portion, wherein said actuator portion is
connected to said base portion so as to form a hingeless connection between said base portion and said actuator portion
extends over said switch, and
is deflectable into contact with said switch, wherein said actuator portion extends beyond said switch by a sufficient distance to assure that an end of said actuator portion contacts said support when overpressures are applied to said lever, thereby directing said overpressures away from said switch, wherein
said switch is spring biased into an open position, and wherein said control lever presents an accumulative spring force which is smaller than the outward biasing forces applied to said switch.

* * * * *